US008925150B2

(12) United States Patent
Pacini

(10) Patent No.: US 8,925,150 B2
(45) Date of Patent: Jan. 6, 2015

(54) ADJUSTABLE HINGE FOR WINDOWS AND DOORS

(71) Applicant: FAPIM S.p.A., Altopascio (Lucca) (IT)

(72) Inventor: Sergio Pacini, Montecarlo (IT)

(73) Assignee: FAPIM S.p.A. (IT)

( * ) Notice: Subject to any disclaimer, the term of this patent is extended or adjusted under 35 U.S.C. 154(b) by 96 days.

(21) Appl. No.: 13/918,163

(22) Filed: Jun. 14, 2013

(65) Prior Publication Data

US 2014/0007378 A1 Jan. 9, 2014

(30) Foreign Application Priority Data

Jul. 6, 2012 (IT) ..... FI2012A0140

(51) Int. Cl.
*E05D 7/00* (2006.01)
*E05D 7/04* (2006.01)

(52) U.S. Cl.
CPC ..... *E05D 7/0018* (2013.01); *E05D 7/0054* (2013.01); *E05D 2007/0063* (2013.01)
USPC ..... 16/241; 16/235

(58) Field of Classification Search
USPC ..... 16/241, 239, 243, 245, 246, 235
See application file for complete search history.

(56) References Cited

U.S. PATENT DOCUMENTS

| | | | | |
|---|---|---|---|---|
| 679,377 | A | 7/1901 | Hibbard | |
| 1,157,548 | A | 10/1915 | Katzenberger | |
| 1,531,164 | A * | 3/1925 | Way | 16/242 |
| 2,004,187 | A * | 6/1935 | Bommer | 403/358 |
| 4,748,717 | A | 6/1988 | Osborne | |
| 5,794,310 | A * | 8/1998 | Dallmann | 16/362 |
| 5,964,012 | A * | 10/1999 | Vigreux | 16/241 |
| 6,070,362 | A * | 6/2000 | Strassel | 49/192 |
| 6,397,432 | B1 * | 6/2002 | di Vinadio | 16/242 |
| 6,484,363 | B1 * | 11/2002 | Chung | 16/242 |
| 6,513,194 | B2 * | 2/2003 | Harkins et al. | 16/239 |
| 6,757,938 | B1 * | 7/2004 | di Vinadio | 16/242 |

(Continued)

FOREIGN PATENT DOCUMENTS

| | | | |
|---|---|---|---|
| DE | 4041340 | A1 * | 7/1992 |
| EP | 0467075 | | 1/1992 |

(Continued)

OTHER PUBLICATIONS

Italian Search Report issued on Feb. 19, 2013 for Italian Application FI2012A000140 filed on Jul. 6, 2012 in the name of FAPIM S.P.A.

(Continued)

*Primary Examiner* — Victor Batson
*Assistant Examiner* — Jason W San
(74) *Attorney, Agent, or Firm* — Steinfl & Bruno LLP

(57) ABSTRACT

An adjustable hinge for doors or windows is described. The adjustable hinge has hinge elements, a tubular cover, a plug and a wall. The hinge elements connect to a fixed frame of a door or a window and mobile frame of the door or the window. The hinge elements are pivotally connected through a pin that is engaged in a housing formed inside the hinge elements. The tubular cover covers the hinge elements which are associated with a locking means. The plug has a channel and is used to engage the housing of the hinge elements with the locking means. The adjustable hinge can also be transversally adjustable.

19 Claims, 3 Drawing Sheets

(56) References Cited

U.S. PATENT DOCUMENTS

| | | | | |
|---|---|---|---|---|
| 6,779,233 | B2 * | 8/2004 | Migli | 16/246 |
| 7,162,774 | B1 * | 1/2007 | Von Resch et al. | 16/236 |
| 7,603,746 | B1 * | 10/2009 | von Resch et al. | 16/245 |
| 8,281,458 | B2 * | 10/2012 | Balbo di Vinadio | 16/235 |
| 2009/0031530 | A1 * | 2/2009 | Barca | 16/243 |
| 2011/0107555 | A1 * | 5/2011 | Buchanan et al. | 16/237 |
| 2013/0104340 | A1 * | 5/2013 | Hasler | 16/238 |

FOREIGN PATENT DOCUMENTS

| | | | |
|---|---|---|---|
| EP | 0553600 | A1 * | 8/1993 |
| EP | 0837206 | | 4/1998 |
| EP | 1061221 | | 12/2000 |
| EP | 11713649 | | 8/2004 |
| EP | 2186980 | | 5/2010 |
| EP | 2194218 | | 6/2010 |
| JP | 02140379 | A * | 5/1990 |
| JP | 05222877 | A * | 8/1993 |
| JP | 05222879 | A * | 8/1993 |
| WO | 0066863 | | 11/2000 |
| WO | 2006060018 | | 6/2006 |

OTHER PUBLICATIONS

Italian Search Opinion issued on Feb. 19, 2013 for Italian Application FI2012A000140 filed on Jul. 6, 2012 in the name of FAPIM S.P.A.

Non-Final Office Action mailed on Nov. 14, 2011 for U.S. Appl. No. 12/856,244, filed Sep. 19, 2009 in the name of Sergio Pacini.

Notice of Allowance mailed on Aug. 27, 2012 for U.S. Appl. No. 12/856,244, filed Sep. 19, 2009 in the name of Sergio Pacini.

* cited by examiner

Fig.1
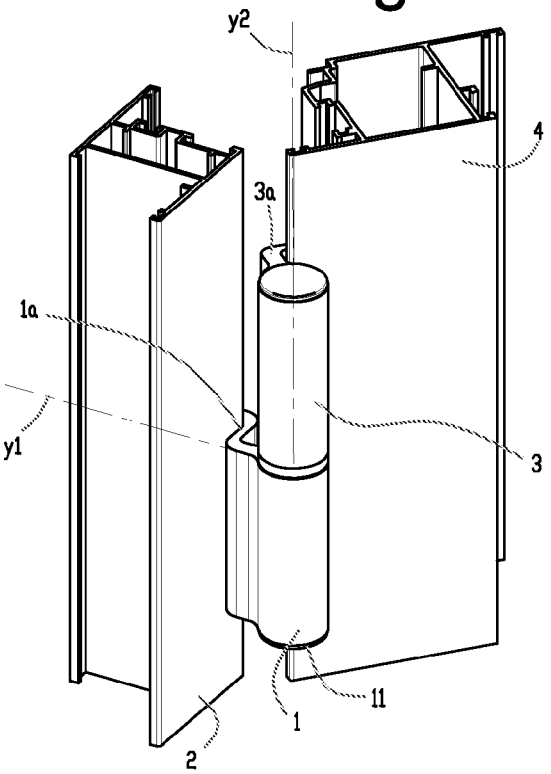
Fig.2
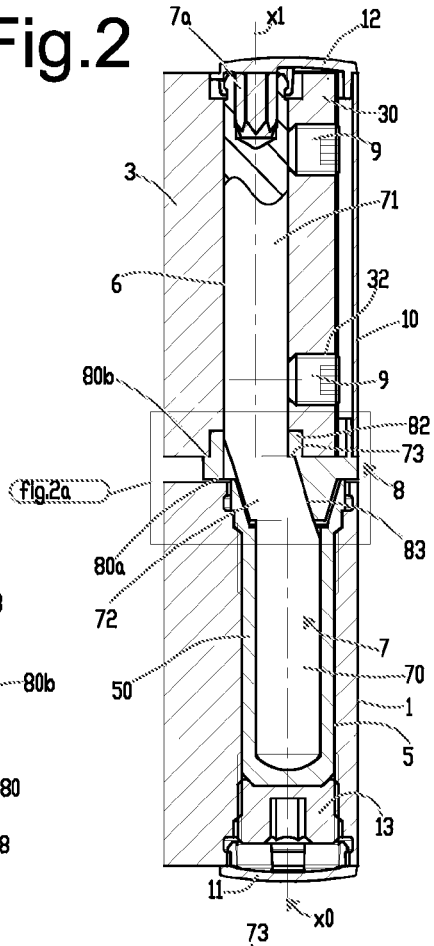
Fig.4
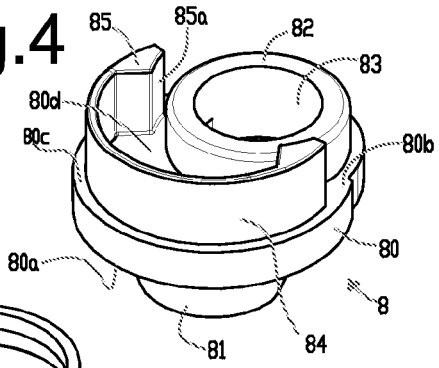
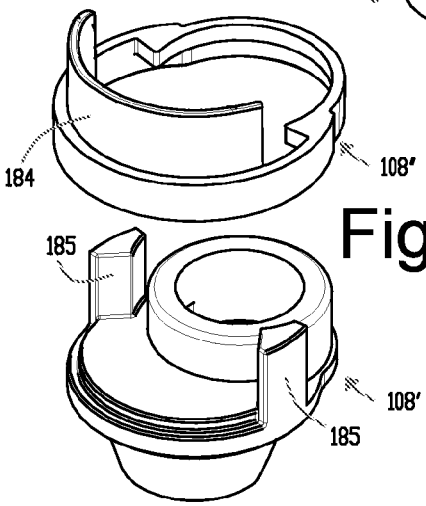
Fig.9
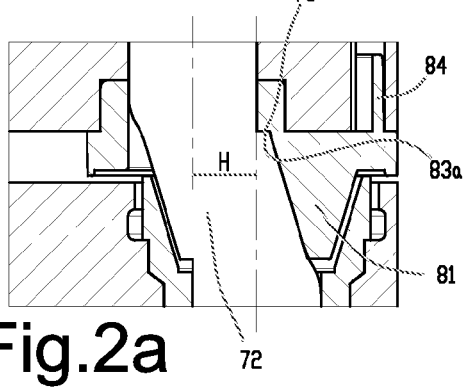
Fig.2a Fig.6
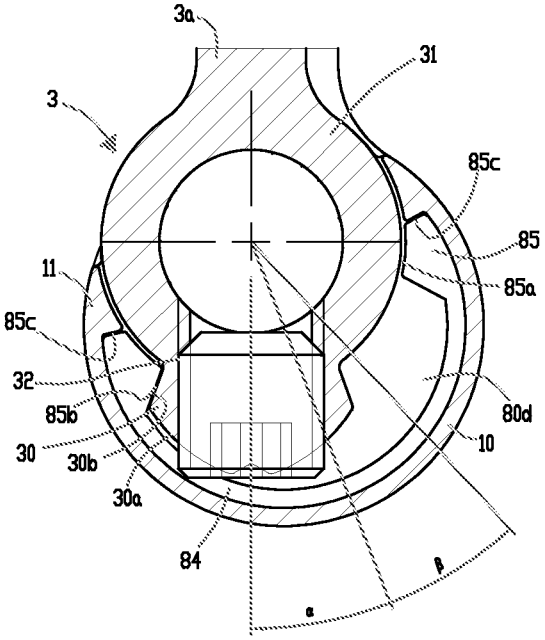
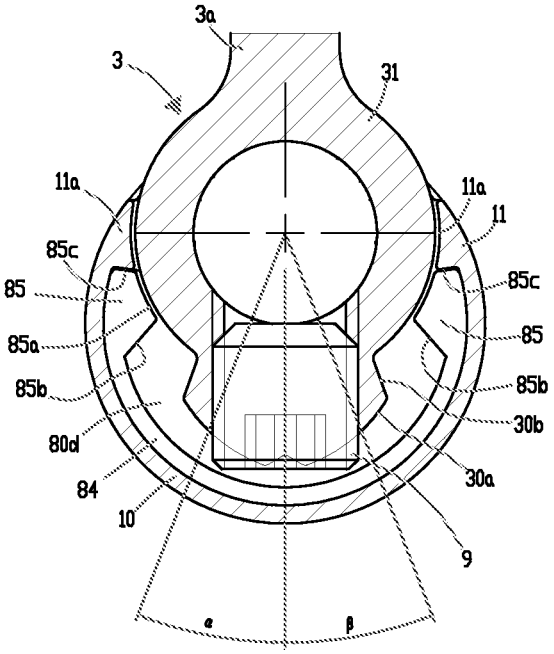
Fig.5
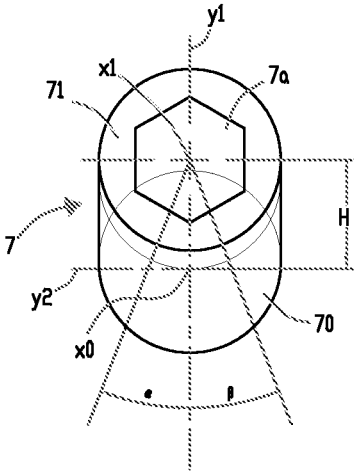
Fig.3

ADJUSTABLE HINGE FOR WINDOWS AND DOORS

CROSS REFERENCE TO RELATED APPLICATIONS

The present application claims priority to Italian Patent Application FI2012A000140 filed on Jul. 6, 2012, which is incorporated herein by reference in its entirety. Additionally, the present application may be related to U.S. Pat. No. 8,381,355 which is also incorporated herein by reference in its entirety.

FIELD

The present disclosure concerns a hinge for doors or windows, and more in particular it refers to a hinge for doors or windows of the type that, in addition to a longitudinal adjustment, also makes it possible for there to be a transversal adjustment.

BACKGROUND

In the field of window and door frames and windows and doors, in particular heavy or big ones, it is particularly recommended to use rotation hinges that have the possibility of adjusting the mutual position between the window or door and the fixed frame. Such an adjustment has the purpose of recovering possible bending of the door or the window or of allowing it to work even in the case in which the mounting of the door or window suffers some geometrical misalignment or displacements.

Among such hinges there are those which allow, in addition to a longitudinal adjustment (that is, with position adaptation along the axis of rotation of the hinge itself), a transversal adjustment (that is, according to a direction lying in a plane perpendicular to the axis of rotation of the hinge and parallel to the wall on which the opening to be shut by the window or door is formed); such an adjustment makes it possible to achieve a substantial off-centering between the two mutually pivoting elements forming the hinge (of which one is connected to the fixed frame and one connected to the actual mobile frame or window or door) so as to compensate for possible positioning errors between the window or door and fixed frame.

Examples of hinges of this type are described in EP2186980, EP2194218 and EP1173649. Such known hinges do, however, have numerous drawbacks. In particular, they are complex, foreseeing a large number of mechanical components, and therefore have high production costs. Moreover, also due to their structural complexity, they are difficult to assemble and adjust. Another example of known hinge is disclosed in WO2006/060018. This hinge comprises a pin through which the pivoting coupling between the two hinge elements is carried out, the pin comprising two end branches joined by an intermediate, inclined deviation portion. In this way the branches result mutually off-centered and parallel, whereby a relative displacement of the hinge elements along an adjustment direction is obtained in response to an adjustment rotation of one of the branches. This hinge still has some of the above mentioned drawbacks and in any case, once the adjustment has been carried out, there are problems in terms of appearance that make the hinge unsatisfactory, or in any case, that make it necessary to adopt and rearrange additional components.

SUMMARY

According to several aspects, the present disclosure provides a hinge for doors or windows, of the type that can be transversally adjusted, which overcomes the drawbacks mentioned above, in particular being structurally simple and therefore less subject to failures, and with lower production and maintenance costs with respect to known hinges.

According to a particular aspect of the disclosure a hinge of the aforementioned type is provided, which can be adjusted in a simple and functional manner, and at the same time has a valuable and clean appearance after the adjustment operations, without an increase of operations or additional components to be mounted afterwards.

According to an aspect of the disclosure, an adjustable hinge for doors or windows is described. The adjustable hinge comprises: two hinge elements, wherein a first hinge element is adapted to be connected to a fixed frame of a door or a window and a second hinge element is adapted to be connected to a mobile frame of the door or the window, said first and second hinge elements being coaxially consecutive along an axis of rotation between said mobile frame and said fixed frame and pivotally connected through a pin that is engaged in correspondent housings formed inside said first and second hinge elements, the pin comprising two end branches adapted to be engaged respectively within said correspondent housings, of which a first branch pivoted around said axis of rotation within a housing of the first or of the second hinge element, and a second branch locked within the other housing of the second or of the first hinge element by locking means, wherein said two end branches of said pin are joined by an intermediate deviation portion, mutually off-centered and parallel, said locking means being releasable to permit an adjustment rotation of said first or of said second end branch with respect to a corresponding hinge element of the first or the second hinge element, whereby a relative displacement of said hinge elements is obtained in response to said adjustment rotation, wherein said intermediate portion is a linear portion that is inclined with respect to said end branches, a tubular cover for covering the two hinge elements to which said locking means are associated, a plug comprising a channel for an integral engagement with an inclined intermediate portion, said plug further comprising reference means adapted to engage in a coaxial and pivotal manner within said housing of said first or second hinge element to which said locking means are associated, and a wall developing circularly along a C-shaped path, centered on said axis of rotation and symmetrical with respect to said pin, on which said tubular cover radially abuts, so that an adaptive rotation of said tubular cover around said axis of rotation occurs as a reaction of the adjustment rotation of said first or second end branch.

BRIEF DESCRIPTION OF THE DRAWINGS

The characteristics and the advantages of the adjustable hinge according to the present disclosure shall become clearer from the following description of an embodiment thereof given as an example and not for limiting purposes with reference to the attached drawings.

FIG. 1 is an axonometric view of the hinge in a typical configuration of use, i.e. associated with a mobile frame of a window or door for mounting the latter to a fixed frame with a vertical axis of rotation.

FIG. 2 is a view of the hinge in longitudinal section, i.e. made according to a plane in which the axis of rotation of the hinge itself lies.

FIG. 2*a* is an enlarged view of FIG. 2 in a central area of the hinge.

FIG. 3 is a plan view of a pin for the rotation of the hinge, represented separately and oriented according to the configuration of use according to the previous figures.

FIG. 4 shows separately, enlarged and in a perspective view, a central plug of the hinge.

FIG. 5 is a cross section view of the hinge (i.e. according to a plan that is perpendicular to the aforementioned axis of rotation), made at the height of an upper element of the hinge in the position of minimum transverse off-centering or of zero adjustment, with the door or window frame in the closed configuration.

FIG. 6, analogously to FIG. 4, shows a cross-section view with the upper element in the position of maximum transverse off-centering or maximum adjustment displacement, again with the window or door frame in the closed configuration.

FIG. 9 shows an exploded and axonometric view of a variant embodiment of the central plug.

DETAILED DESCRIPTION

Figure 7:
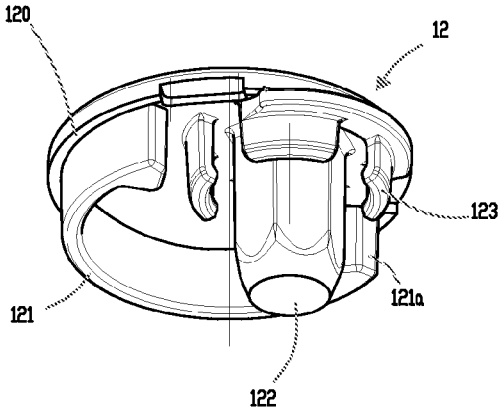
FIG. 7 is an axonometric view of an upper closing cap of the hinge.

For the sake of clarity, and with no limiting purposes, in the present description the terms "lower" and "upper" refer to the ground plane and consequently to a typical configuration of use of the hinge with vertical axis of rotation; for example and in particular, by "lower" it is thus meant an element of the hinge that is made integral with the fixed frame and that is intended to always be closest to the ground plane, vice versa by "upper" there is meant an element that is made integral with the mobile frame of the door or the window arranged higher with respect to the same plane.

With reference to the aforementioned figures, the hinge according to the disclosure comprises in the depicted embodiment, as mentioned, two hinge elements one on top of the other, of which the lower element 1 is adapted to be connected integral with a fixed frame 2 of a window, door etc. and the upper element 3 is integrally connected to an upright 4 of a mobile frame of the window or door. The connection between the hinge elements and the frame/upright is carried out with conventional methods, such as screws that secure to the frame/upright respective connection wings 1*a*, 3*a* extending from the hinge elements.

The lower hinge element 1 is substantially cylindrical whereas the upper hinge element 3 has a substantially cylindrical main body 31 from which a rib 30 projects, according to a first transversal (i.e. radial) direction Y1. The rib 30, running longitudinally along the body 31, has a curved head face 30*a*, with a curvature that can be compared to that of the main body, and slanting sides 30*b* that connect the head face to the external surface of the body itself.

The hinge elements 1, 3 are substantially tubular, so as to define, on the inside, corresponding cylindrical through housings 5, 6 for housing a pin 7 that allows for the pivoting coupling between the two hinge elements. The upper hinge element, or more precisely the relative main body 31, has a diameter that is smaller than the lower element, with the effect that shall be understood from the foregoing description.

The pin 7 (shown separately in FIG. 3) comprises two end branches with a cylindrical section, joined to one another so as to be parallel but not coaxial, thus overall obtaining a substantially S-like shape. One lower end branch 70 inserts in the respective lower housing 5 whereas one upper branch 71 inserts in the respective upper housing 6. Each of the branches moreover defines a central axis thereof respectively X0, X1, such axes; of course, coincide with the axes of the housings of the hinge elements. More precisely, the two straight end branches 70, 71, and in particular the axes X0, X1 thereof are mutually off-centered by an amount H (indicated in FIG. 3 and in FIG. 2*a*) according to the first transversal direction Y1, such a direction, lying in a plane perpendicular to the axes X0, X1, being also perpendicular to the plane of the fixed frame.

The connection between the two end branches of the pin 7 is carried out via an intermediate portion 72, in turn cylindrical, but with a longitudinal development that is substantially smaller with respect to the end branches, and has a slanted axis.

The hinge according to the disclosure further comprises a plug 8 that is arranged between the two elements 1, 3 and is provided with a slanted through channel 83 that houses the intermediate portion 72 of the pin 7 in a locked manner. The plug 8, which will be described in detail hereafter, moreover provides a crescent-shaped step 83*a* formed within the through channel 83, which as shown in particular in FIG. 2*a*, abuts on a shoulder 73 formed on the pin 7 between the upper straight branch 71 and the slanted intermediate portion 72. The step and the shoulder are such that the first rests on the second, due to gravity, and as a consequence the load stress is discharged from the plug onto the pin.

The upper end branch 71 can be locked, and is indeed locked in the normal use of the hinge, within the respective upper housing 6 through the forcing action of threaded screw members 9. The latter engage in threaded holes 32 obtained in a radial direction on the rib 30. In order to permit the mutual rotation of the two hinge elements and therefore the rotation of the mobile frame with respect to the fixed frame, the lower end branch 70 is on the other hand pivotable inside the respective lower housing 5 that is suitably covered by a bushing 50 made from material with low friction coefficient.

Adjustment means are associated to the pin 7, said means comprising in particular, according to the illustrated embodiment, a hexagonal-shaped seat 7*a* formed at the top of the pin 7 coaxially with the axis (X1), suitable for the insertion with a tool of the known type such as a hex key. By acting on the pin 7 through such a tool it is possible, upon loosening the screws 9, to control its relative rotation around the axis X1 of the upper branch 71 with respect to the upper element 3. Such a rotation, due to the off-centering between the two branches of the pin and of the constraint exerted by the lower element that is integral with the fixed frame, has the effect of moving the aforementioned axis X1 with respect to the axis X0 of the lower branch 70, along a second transversal direction Y2 that actually represents the desired transversal adjustment direction (i.e. a direction on a plane perpendicular to the axis of the rotation of the hinge, represented by X0, and parallel to the plane of the fixed frame). Such a displacement is easily understood by comparing FIGS. 5 and 6, which indeed refer to a position of zero adjustment (axes X0 and X1 being aligned along the direction Y1) and to a position of maximum displacement in the adjustment direction Y2.

As shown in FIG. 3, the off-centered adjustment according to Y2 can occur both with a movement towards or away from one another, corresponding respectively to relative angular displacements $\alpha$ (for the adjustment towards one another) and $\beta$ (for the adjustment away from one another).

Returning now to the plug 8 (shown on its own in FIG. 4), this has a central portion 80 that is substantially disc-shaped with flat faces 80*a*, 80*b* respectively facing the lower hinge element and the upper hinge element. The upper flat face 80*b* acts as an abutment surface for the upper hinge element 3, whereas the lower flat face 80*a* is kept slightly spaced from the lower hinge element 1 due to the resting of the lower branch 70 at the bottom of the bushing 50.

Some projections extend from such flat faces, one of which is a substantially cylindrical upper projection 82 that is engaged in a suitable flaring made at a lower end of the upper housing 6, and a lower projection 81 having a concave conical segment that is engaged in the lower housing 5, although without contact, i.e. with a certain clearance. For such a purpose the already mentioned bushing 50 indeed has a flared mouth with a conical shape so as to allow the housing of the intermediate slanted portion 72 of the pin 7, and at the same time of the lower projection 81 that at least partially wraps the same portion 72. In practice, the lower projection 81 has such a shape as to match the slanted portion 72 thus giving the group an overall truncated cone shape (see in particular FIG. 8) which is housed with clearance in the conically flared mouth of the bushing 50.

The channel 83 is slanted and opens on the aforementioned projections, which in turn are thus off-centered so as to be spaced correspondingly to the distance H between the aforementioned axes X0, X1 of the end branches 71, 72 of the pin 7.

With particular reference again to FIGS. 5 and 6, a wall 84 rises from the upper flat face 80*b* developing in a C-shaped circle, so as to be centered on the axis X0 and symmetrical with respect to the plane X0-X1, along a part of the periphery of the central disc 80, spaced however from the aforementioned periphery so as to define a free strip 80*c*. A chamber 80*d* is moreover delimited between the concave side of the wall 84, i.e. facing towards the centre of the disc, and the upper cylindrical projection such as to house the rib 30 of the upper hinge element. The wall 84 further comprises a shaped end teeth 85 that thickens the same wall by projecting towards the centre of the disc. The side surface of each tooth 85 has an inner concave face 85*a* that fronts, following its curvature, the cylindrical side surface of the upper hinge element 3. The concave face 85*a* joins the concave side of the wall 84 via an abutment face 85*b*, having a substantially radial arrangement, which represents the actual delimitation of the chamber 80*d*. A head face 85*c*, on the other hand, joins the inner concave face 85*a* to the outer side surface of the wall 84, representing its end.

When the hinge is in the zero adjustment position (FIG. 5) the rib 30 occupies the center of the chamber 80*d*, with the wall 84 which is consequently symmetrical with respect to the rib. On the other hand, when the hinge is in the maximum transversal adjustment position, an abutment face 85*b* acts as an end stop for the rib 30, through the abutment with one of the slanting sides 30*b* (FIG. 6). Obviously, the rib abuts with one or the other inner abutment face according to whether the transversal adjustment is towards one another or away from one another.

The hinge is finished off with a cover 10 that is arranged so as to partially wrap the upper hinge element 3 and offer the hinge a continuous external surface even following the adjustment movement, in spite of the off-centering between the two hinge elements 1, 3. For such a purpose, the cover, substantially a tubular cylinder with an open C-shaped section having a suitable diameter, is arranged and kept coaxial (despite the adjustment movement) with the lower hinge element 1, hiding the rib 30 and reaching the external surface of the main body 31 of the upper element in proximity to the connection wing 3*a* (as can be clearly seen in FIGS. 5 and 6).

The cover 10 thus has an outer diameter corresponding to that of the lower element 1 and, since it is arranged coaxially with respect to it, gives also the upper element the same diameter, forming an outer side surface of the hinge that is completely continuous in the transition between the two elements. In order to achieve this result, the cover 10 is arranged, at the bottom, resting on the peripheral free strip 80*c* of the disc 80 of the plug 8, in radial abutment on the wall 84, and has, along the free edges, respective shaped projections 11, adapted to hook onto the teeth 85 of the same wall, in particular for abutting on the head faces 85*c*. The projections 11 also have concave faces 11*a* that, like the concave faces 85*a* of the teeth 85 and continuously with them, front, following the curvature, the cylindrical side surface of the upper hinge element. Such a surface is substantially joined up with the external surface of the cover, with a minimal discontinuity and, in any case, with almost no negative impact on the appearance of the hinge.

The cover 10 finishes off its work of improving the appearance of the hinge, thanks to a closing cap 12, which is arranged over the upper hinge element 3 so as to shut the housing 6. The cap 12 engages in a reversible manner with the cover 10 and with the pin 7 by means of the seat 7*a*; the removal is indeed necessary in order to access the seat 7*a* for actuating/adjusting the pin 7. More in detail, the cap 12 is in turn used as a support and reference means for the cover 10 in the upper area, again so as to keep the cover itself coaxially centred with the disc 80 and therefore with the lower element 1 (axis X0).

Figure 8:
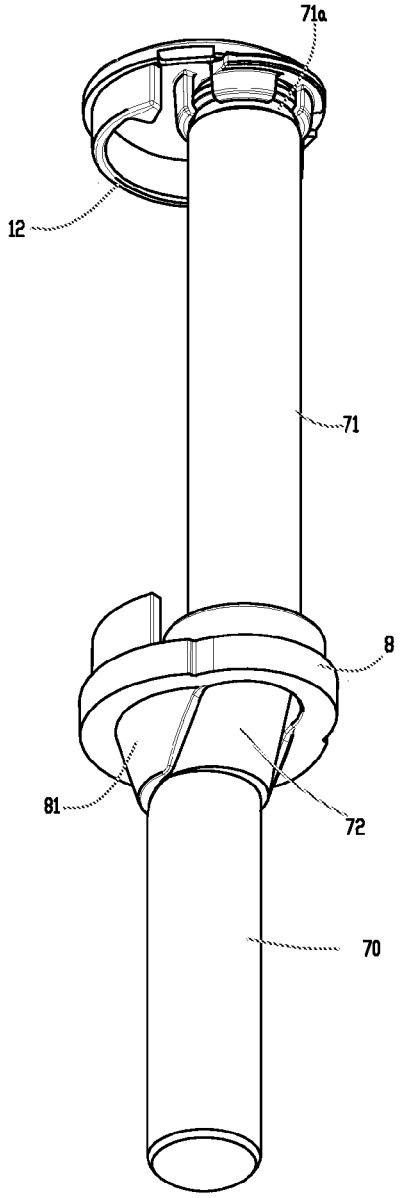
FIG. 8 shows an axonometric view from below of the central plug mounted on the pin of rotation of the hinge, represented separately.

For such a purpose the cap 12, as shown in FIGS. 7 and 8, comprises, on a disc-shaped base 120, an analogous wall 121, shaped analogously to the wall 84 of the plug 8. The wall 121 of the cap indeed has an arc-shaped peripheral development and shaped teeth 121*a* for engaging with the cover, as well as for the end-stop abutment of the rib 30. A peg 122 also extends from the disc-shaped base 120 so as to engage with the seat 7*a*, having thus the same cross-section (for example hexagonal-shaped). The cap advantageously further has lips 123 that, projecting annularly from the disc-shaped base around the peg 122, are adapted to snap fit with the end of the upper branch of the pin 7. For this purpose, such an end can advantageously have peripheral connection throats 71*a*.

A bottom 11 finally closes the housing 5 of the hinge element 1. Between the bottom 11 and the bushing 50, within the housing 5, longitudinal adjustment means 13 of the known type are housed, like for example a screw that acts on the bushing, not described in detail.

The hinge, according to the present disclosure, can have several advantages. First of all the transversal adjustment can occur in a simple and rapid manner, without being necessary to dismount the hinge or portions thereof (it is sufficient to remove the cap 12). A simple rotation, which can be exerted with tools that can be easily found on the market, such as a hex key, leads to a precise and reliable adaptive control of the mutual position between the fixed frame and the mobile frame. This is accomplished with a hinge that is simple in terms of its construction since it is made by a small number of components. Consequently, the production costs are extremely low.

A further aspect of the disclosure lies also in the fact that, thanks to the particular solution provided by the cover and by the suitably shaped plug, the hinge, contrarily to known solutions, has a pleasing appearance because as mentioned there is always the continuity of the external surface also during the adjustment and in the maximum transversal adjustment positions. The alignment between the cover and the lower element of the hinge is strongly kept, and, at the same time, the cover dynamically adapts to the relative displacement of the upper element, in a completely automatic manner, without any need for being rearranged manually; this is due to the connection of the cover to the plug, with which it is integral, and to the fact that the plug, during the rotation of the pin 7, rotates around X0.

More in detail, during normal operation of the hinge the pin-plug assembly rotates around X0 (the unit formed by the intermediate portion 72 and the lower projection 81 being a conical male part that rotates in the conical housing of the bushing 50). The cover 10 remains integral with the upper hinge element.

In order to carry out the adjustment, the cap 12 is removed and, by operating as already indicated above on the pin 7, the reference means for the cover (wall 84) rotate integrally with the pin around the axis X0, with the functional and aesthetic result that has just been described. In the same way also the seat 7*a* rotates, so that when the cap 12 is rearranged, it can be engaged with the same seat and with the cover 10 exactly like before, integrally supporting the cover even at the upper end. Practically, it is like if also the cap, in addition to the plug, were rotated as a unit with the pin to keep the cover in the desired alignment with the lower hinge element.

Of course, the orientation of the seat 7*a* with respect to the central plug and the orientation of the peg 122 in relation to the wall 121 are coherent with one another, and in particular, advantageously, are such that the seat 7*a* and the peg 122 have two opposite angles that are aligned according to the plane X0-X1 (such a plane, in the zero adjustment position, developing according to the transversal direction Y1). Since the coupling between the seat and the hexagonal pegs can occur only in three specific angles that are angularly spaced by 120°, during the rearrangement of the cap, the angle that automatically aligns the cap itself with respect to the pin can be easily chosen.

The cover remains centered on the lower element (it is engaged with the wall 84) rotating as a unit with the plug around the axis X0 due to the integral engagement with the intermediate slanting portion. Such a rotation results in a dynamic adaptation of the cover 10 in relation to the upper element (see FIGS. 5 and 6).

Again, a further advantage is given by the fact that the hinge, according to the present disclosure, is suitable for supporting also heavy loads. The pin has a constant section and therefore it does not have areas of potential structural weakness. Moreover, the shoulder 73 carries out an extremely important role in supporting the load (weight of the mobile frame), which is transmitted from the upper element to the plug 8 and, indeed, from this to the pin 7. Such a solution ensures that the hinge, having a wide possibility of transversal adjustments, is in any case suitable for being used in industrial applications (that is, big sized window or door frames).

The material used for the pin can be a metal material with high mechanical resistance, like for example steel. The pin can be made through metalworking operations such as turning, although other solutions can also be foreseen such as casting, etc.

The cap and the bottom can be made from plastic material. For the plug, due to the stress it is subjected to, a metal material is, on the other hand, indicated. However, in order to optimise the appearance of the hinge in relation to the other components, the plug can have a core made from metal material and a hoop lining made from plastic material. Such a variant embodiment is illustrated in FIG. 9, in which it can be noted that in this case there is a central wall portion 184 which is integral with the peripheral plastic hoop lining, indicated with reference numeral 108". On the other hand, the end teeth 185 are integral with the core of the plug 108', the end teeth forming the two portions giving continuity to the abutment wall like in the previous embodiment. The hoop lining 108" is ring-like and shaped so as to be engaged with the core 108', suitable machining being carried out to obtain a forced and/or snap fit engagement.

Despite the spatial references used in the present description, it is obvious that equivalent configurations that are arranged with different orientation or also configurations that are mirrored, with respect to the one in the example above, are within the scope of the disclosure.

The present disclosure has been described with reference to several embodiments. It should be understood that other embodiments can be foreseen that belong to the same inventive core, all covered by the following claims.

The invention claimed is:

1. An adjustable hinge for doors or windows, comprising:

two hinge elements, wherein a first hinge element is adapted to be connected to a fixed frame of a door or a window and a second hinge element is adapted to be connected to a mobile frame of the door or the window, said first and second hinge elements being coaxially consecutive along an axis of rotation between said mobile frame and said fixed frame and pivotally connected through a pin that is engaged in correspondent housings formed inside said first and second hinge elements, the pin comprising two end branches adapted to be engaged respectively within said correspondent housings, of which a first branch is configured to pivot around said axis of rotation within a housing of the first or of the second hinge element, and a second branch is locked within the other housing of the second or of the first hinge element by locking means, wherein said two end branches of said pin are joined by an intermediate deviation portion, so as to result mutually off-centered and parallel, said locking means being releasable to permit an adjustment rotation of said first or of said second end branch with respect to a corresponding hinge element of the first or the second hinge element, whereby a relative displacement of said hinge elements is obtained in response to said adjustment rotation, wherein said intermediate portion is a linear portion that is inclined with respect to said end branches, the hinge further comprising:

a tubular cover for covering the hinge element to which said locking means are associated, a plug comprising a channel for an integral engagement with an inclined intermediate portion, said plug further comprising reference means adapted to engage in a coaxial and pivotal manner within said housing of said first or second hinge element to which said locking means are associated, and a C-shaped wall, connected to said plug, developing circularly a C-shaped path, centered on said axis of rotation and symmetrical with respect to said pin, on which said tubular cover radially abuts, so that an adaptive rotation of said tubular cover around said axis of rotation occurs as a reaction of the adjustment rotation of said first or second end branch.

2. The adjustable hinge according to claim 1, wherein, when the hinge is installed on said door or window and said mobile frame is in a closed position, said two end branches are off-centered along a direction orthogonal to a plane defined by said mobile frame, said relative displacement of said two hinge elements in response to said adjustment rotation occurring along an adjustment direction parallel with said plane and orthogonal with said axis of rotation.

3. The adjustable hinge according to claim 1, wherein said locking means comprise at least one threaded screw member engaged in an at least one correspondent threaded hole formed in a radial direction on a relative hinge element.

4. The adjustable hinge according to claim 1, wherein said plug has a substantially disc-shaped central portion with flat faces adapted to front said first and said second hinge elements, respectively, from such flat faces projecting, respectively, a first projection in a fashion of a concave conical segment housed in said housing for pivotal engagement with the pin, inside said first projection being formed said channel for engagement with said intermediate deviation portion of the pin, and said reference means in the form of a second substantially cylindrical projection that is pivotally engaged within the housing, which has been locked by the pin.

5. The adjustable hinge according to claim 4, wherein a wall rises from one of said flat faces along a portion of the periphery of said disc-shaped central portion spaced from a periphery so as to define a free strip for a resting of the tubular cover.

6. The adjustable hinge according to claim 5, wherein said wall has shaped end teeth that project from a concave side thereof towards a centre of said disc-shaped central portion, each tooth providing an inner concave surface that fronts an external surface of a respective hinge element, said inner concave surface being joined to the concave side of said wall by an abutment face having a substantially radial arrangement, a head face joining said inner concave surface to an external surface of said wall.

7. The adjustable hinge according to claim 6, wherein the tubular cover, along free edges, has respective shaped projections adapted to engage on said teeth of said wall abutting on said abutment faces, said respective shaped projections further comprising concave faces that front the external surface of the respective hinge element each in continuity with respective concave sides of said wall.

8. The adjustable hinge according to claim 4, wherein said plug is an assembly of two portions including a core on which a hoop lining is inserted, the hoop lining comprising a central wall portion, end teeth being integral with said core, said core and said hoop lining being made of different materials and mutually engaged so that said end teeth and said central wall portion define said wall of said plug.

9. The adjustable hinge according to claim 4, wherein said first or said second hinge elements to which said locking means are associated, has a substantially cylindrical main body from which a rib projects running longitudinally along a body, said locking means being engaged with said rib.

10. The adjustable hinge according to claim 9, wherein said rib is housed within a chamber defined between a concave side of a wall and a cylindrical projection.

11. The adjustable hinge according to claim 10, wherein said rib comprises slanting sides adapted to abut against one or the other abutment faces.

12. The adjustable hinge according to claim 1, wherein said plug further comprises a crescent-shaped step formed within said channel, in turn having a slanting arrangement, a step abutting against a shoulder formed in said pin between said first or second end branch to which said locking means are associated, and on said slanted arrangement, said step and said shoulder resting on each other for transmitting a load between the pin and the mobile frame or the fixed frame.

13. The adjustable hinge according to claim 1, wherein said first or second end branch to which said locking means are associated, comprises a seat with an axis coinciding with an axis of the two end branches, adapted to be engaged with a tool to drive said adjustment rotation.

14. The adjustable hinge according to claim 13, wherein a closing cap is arranged on the first or second hinge element to which said locking means are associated, closing the relative housing, and at the same time releasably engaging with said tubular cover and with a seat of said pin.

15. The adjustable hinge according to claim 14, wherein said cap comprises a wall developing circularly along a C-shaped path adapted to be centered on said axis of rotation, with shaped teeth for engaging with said cover.

16. The adjustable hinge according to claim 14, wherein said cap comprises a substantially disc-shaped base from which a peg projects adapted for engagement with said seat, the cap further comprising lips projecting annularly from said disc-shaped base around said peg to snap fit with the end of said pin in which said seat is formed.

17. The adjustable hinge according to claim 16, wherein said seat and said peg have a polygonal outline, the orientation of said seat with respect to said central plug and the orientation of said peg with respect to said wall being in mutual accordance, e.g. such that the seat and the peg have two opposite angles aligned according to a plane defined by said axis of rotation and by said axis of the two end branches.

18. The adjustable hinge according to claim 1, wherein the hinge element to which said locking means is associated with is the second hinge element that is fixed or adapted to be fixed to the mobile frame.

19. The adjustable hinge according to claim 1, wherein said axis of rotation is a substantially vertical axis, said first and second hinge elements being a lower element and an upper element, respectively.

* * * * *